US005560179A

United States Patent [19]

Leifeld

[11] Patent Number: 5,560,179

[45] Date of Patent: Oct. 1, 1996

[54] APPARATUS FOR HANDLING FLAT COILER CANS BEFORE, DURING AND AFTER FILLING BY A SLIVER PRODUCING TEXTILE PROCESSING MACHINE

[75] Inventor: Ferdinand Leifeld, Kempen, Germany

[73] Assignee: Trützschler GmbH & Co. KG, Mönchengladbach, Germany

[21] Appl. No.: 416,029

[22] Filed: Apr. 3, 1995

Related U.S. Application Data

[63] Continuation-in-part of Ser. No. 243,489, May 16, 1994.

[30] Foreign Application Priority Data

Apr. 2, 1994 [DE] Germany ..... 44 11 547.4

[51] Int. Cl.[6] ..... B65B 63/04

[52] U.S. Cl. ..... 53/118; 53/67; 53/503; 53/245; 53/249; 19/159.R; 19/159.A

[58] Field of Search ..... 19/157, 159.A, 19/159.R, 160; 242/361.4, 361.5, 363; 141/163, 167, 168, 175, 250, 267, 270, 283; 53/64, 67, 70, 71, 116, 117, 118, 235, 245, 249, 250, 251, 429, 430, 473, 503

[56] References Cited

U.S. PATENT DOCUMENTS

| | | | |
|---|---|---|---|
| 2,971,244 | 2/1961 | Foller et al. | 53/116 |
| 3,059,908 | 10/1962 | Friedel | 53/429 |
| 3,351,992 | 11/1967 | Carter | 53/429 |
| 5,237,726 | 8/1993 | Gartenmann et al. | 19/159 R |
| 5,412,845 | 5/1995 | Ueding et al. | 19/159 R |

FOREIGN PATENT DOCUMENTS

| | | | |
|---|---|---|---|
| 0457099 | 11/1991 | European Pat. Off. . | |
| 0592799 | 4/1994 | European Pat. Off. . | |
| 1107566 | 5/1961 | Germany . | |
| 1158420 | 11/1963 | Germany . | |
| 333396 | 8/1930 | United Kingdom | 19/159 A |
| 1165193 | 9/1969 | United Kingdom | 19/159 R |
| 1258009 | 12/1971 | United Kingdom | 19/159 R |

*Primary Examiner*—Lowell A. Larson
*Assistant Examiner*—Daniel Moon
*Attorney, Agent, or Firm*—Spencer & Frank

[57] ABSTRACT

A conveyor apparatus for moving flat coiler cans into and out of a sliver filling station and for reciprocating the cans in the sliver filling station while being filled with sliver by a sliver producing textile machine, includes a conveyor element extending along a filling path within the sliver filling station and along a conveying path beyond the sliver filling station; and a drive for unidirectionally moving the conveyor element to introduce a can into or withdraw a can from the sliver filling station along the conveying path and for reciprocating the conveyor element to displace a can back-and-forth along the filling path.

9 Claims, 5 Drawing Sheets

APPARATUS FOR HANDLING FLAT COILER CANS BEFORE, DURING AND AFTER FILLING BY A SLIVER PRODUCING TEXTILE PROCESSING MACHINE

CROSS REFERENCE TO RELATED APPLICATIONS

This application is a continuation-in-part of application No. 08/243,489 filed May 16, 1994.

This application claims the priority of German Application No. P 44 11 547.4 filed Apr. 2, 1994, which is incorporated herein by reference.

U.S. patent applications Ser. No. 08/416,028 filed Apr. 3, 1995 and 08/416,030 filed Apr. 3, 1995 contain related subject matter.

BACKGROUND OF THE INVENTION

The invention relates to an apparatus for handling flat coiler cans before, during and after filling the cans with sliver, such as cotton sliver or chemical fiber sliver, by a sliver producing textile machine such as a drawing frame. The flat cans have an elongated horizontal cross section. The sliver is discharged by a coiler head which rotates about a stationary axis and the sliver is deposited in coils while the coiler can which undergoes filling is reciprocated in its longitudinal direction. The apparatus further has a conveyor track between the charging position (sliver filling station) and an empty-can and full-can storing device. The can can be shifted back-and-forth in the sliver filling station and may be advanced to or removed from the sliver filling station on the conveyor track.

WO Publication No. 91/18135 discloses an apparatus in which an empty-can storing device and a full-can storing device are positioned in series. With the two can storing devices in each instance can displacing devices constituted by conveyor belts or chains are associated which are deflected immediately adjacent a further conveyor belt or a further conveyor chain by means of end rollers. The conveyor belt or conveyor chain extends from the can storing device to the vicinity of the coiler head of the drawing frame and is deflected by end rollers. The conveyor chain drives a carrier which engages a flat can and advances the same up to the zone of the coiler head where the flat can is taken over by two arms of a can shifting device which functions as a can-reciprocating apparatus. The arms can be swung back out of the zone of the flat can to ensure that the flat can may be brought by the conveyor belt into the can-reciprocating zone of the drawing frame and furthermore, the arms are movable toward one another to form a gripper to firmly clamp the flat can between themselves. The can-reciprocating apparatus is required because, as opposed to a sliver-deposition into coiler cans of circular cross section, the coiler head of the drawing frame cannot distribute the sliver in a uniform manner in a flat can. To ensure that the required can-reciprocating motion during the filling operation is not interfered with, the conveyor chain is returned from the reciprocating zone into the base position in which the can carrier is situated on that side of the can storing device which is oriented away from the drawing frame. An additional conveyor chain with a carrier is provided which is deflected by end rollers. The end rollers are so arranged that the carrier may be brought into the immediate vicinity of the coiler head from that side of the can storing device which is oriented away from the drawing frame to receive a flat can so that the flat can may then be taken over by the arms. The end rollers of the conveyor chain are so arranged that the flat can may be brought back into the can storing device by the carrier which is first situated on the side oriented away from the can storing device. The conveyor chains are, along a certain length portion, arranged parallel to one another whereby their effective range overlaps. The two conveyor chains together form a can shifting device to supply and to remove the flat cans. It is a disadvantage of such a prior art arrangement that it is complex both structurally and as a part of the system. It is a particular drawback that the can moving device is a two-part construction requiring two separate shifting devices for the flat cans. It is a further disadvantage that the separate shifting devices have to be separately driven and their control has to be designed with additional technological input and expense. Further, during operation, delays are caused by the switchover times from one shifting device to the other.

SUMMARY OF THE INVENTION

It is an object of the invention to provide an improved apparatus of the above-outlined type in which the discussed disadvantages are eliminated and which, in particular, is simple both structurally and as part of a system and makes possible an increased production rate.

This object and others to become apparent as the specification progresses, are accomplished by the invention, according to which, briefly stated, the conveyor apparatus for moving flat coiler cans into and out of a sliver filling station and for reciprocating the cans in the sliver filling station while being filled with sliver by a sliver producing textile machine, includes a conveyor element extending along a filling path within the sliver filling station and along a conveying path beyond the sliver filling station; and a drive for unidirectionally moving the conveyor element to introduce a can into or withdraw a can from the sliver filling station along the conveying path and for reciprocating the conveyor element to displace a can back-and-forth along the filling path.

By virtue of the fact that a single conveyor element is used for both can displacements, that is, for the reciprocating motion along the filling path in the sliver filling station and for the conveying motion to and from the can-storing device along the conveying path, the conveyor apparatus according to the invention is significantly simplified both structurally and as part of a system. It is a further advantage that the switchover between the two motions is effected rapidly so that a high output rate is feasible. The two motions may have an immediate or continuous transition. Furthermore, an adaptation to the different speeds in the different motion processes is facilitated. The switchover between the two motion processes is effected in a simple manner by one and the same control device.

The invention has the following additional advantageous features:

- The conveyor apparatus is associated with the sliver producing textile processing machine, for example, a drawing frame and a can-storing device.
- The conveyor apparatus is situated below or laterally of the can.
- The conveyor apparatus moves a sled, carriage or the like on which the can is supported.
- The conveyor apparatus moves the can on a conveyor device such as a roller track.
- The conveyor apparatus has an endless conveyor element such as a toothed belt.

The conveyor apparatus has a driving device such an electric motor which may be a reversible motor, an rpm-regulatable motor, a d.c. motor or an a.c. servomotor.

An electronic control-and-regulating device, for example, a microcomputer, is provided to which the drive motor of the conveyor apparatus is connected.

A sensor for determining the fill level of the coiler can is connected to the control and regulating device.

The conveyor apparatus is connected with a path sensor, for example, an incremental path sensor for determining the momentary location of the can on the filling path and on the conveying path.

The drive motor is designed to switch over between the drive for the filling path and for the conveying path.

DESCRIPTION OF THE PREFERRED EMBODIMENTS

Figure 1A:
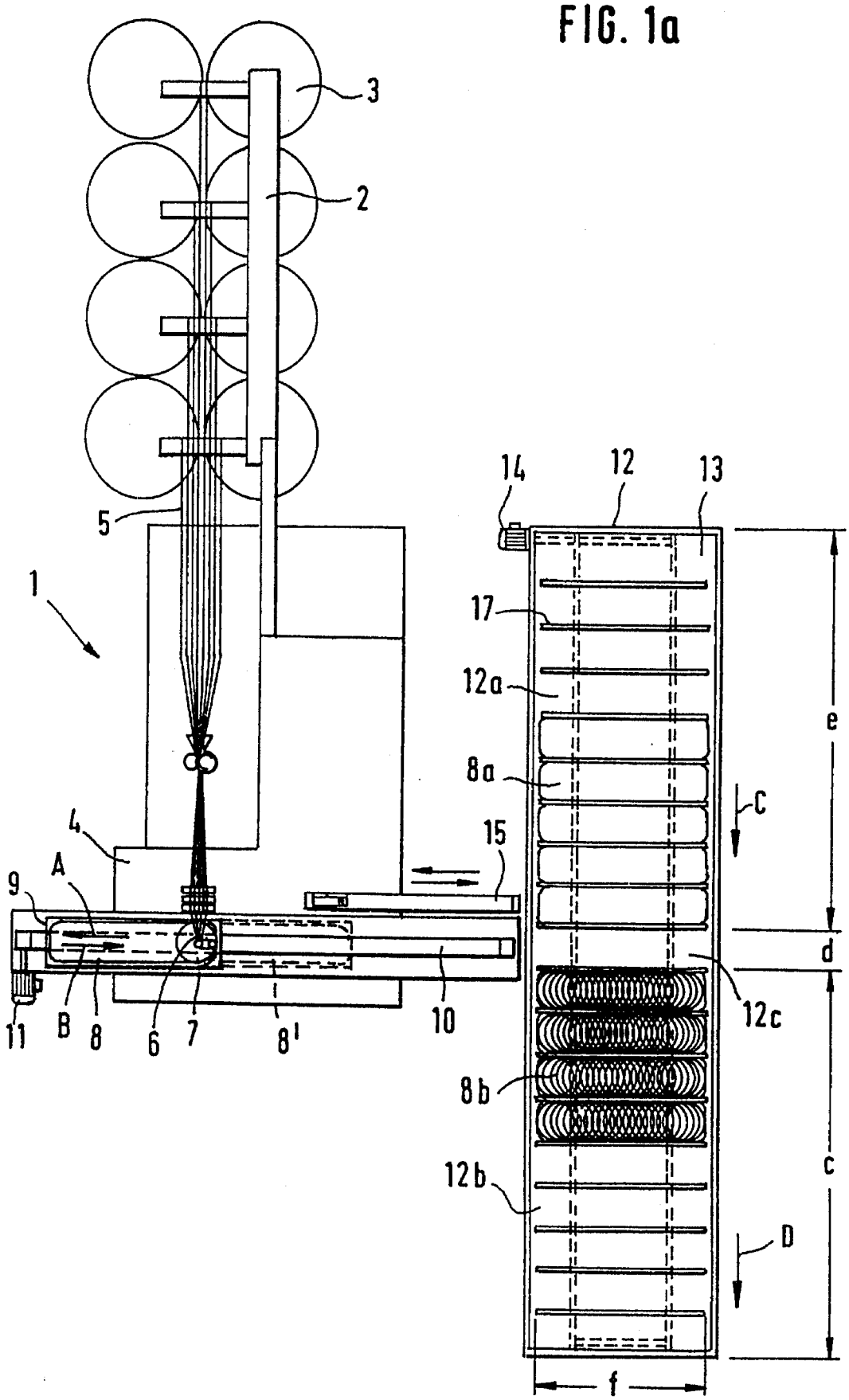
FIG. 1*a* is a schematic top plan view of a drawing frame, a can filling mechanism as well as a can conveying mechanism and a can storing device.

Turning to FIG. 1*a*, there is illustrated therein a drawing frame 1 which may be, for example, an HS 900 model manufactured by Trützschler GmbH Co. KG, M önchengladbach, Germany. To the sliver guiding table 2 of the drawing frame 1 eight coiler cans 3 are transported from a non-illustrated carding machine. In operation of the drawing frame 1, eight slivers 5 are withdrawn from cans 3, guided over the sliver guiding table 2, and advanced to a drawing unit 4 of the drawing frame 1. The thickness of the sliver outputted by the drawing frame corresponds to the thickness of the individual inputted slivers. The sliver 6 produced by the drawing frame 1 is deposited by a coiler head 7, which forms part of the drawing frame 1, into a coiler can 8 which, after it is filled, is moved away from under the coiler head 7. The coiler can 8 is a flat can having an elongated, generally rectangular horizontal cross-sectional outline. After the coiler can 8 has been moved away from the coiler head 7, it is advanced via a can storing device 12 and a non-illustrated can transporting vehicle to a non-illustrated further processing unit, such as an open end spinning machine.

Figure 1B:
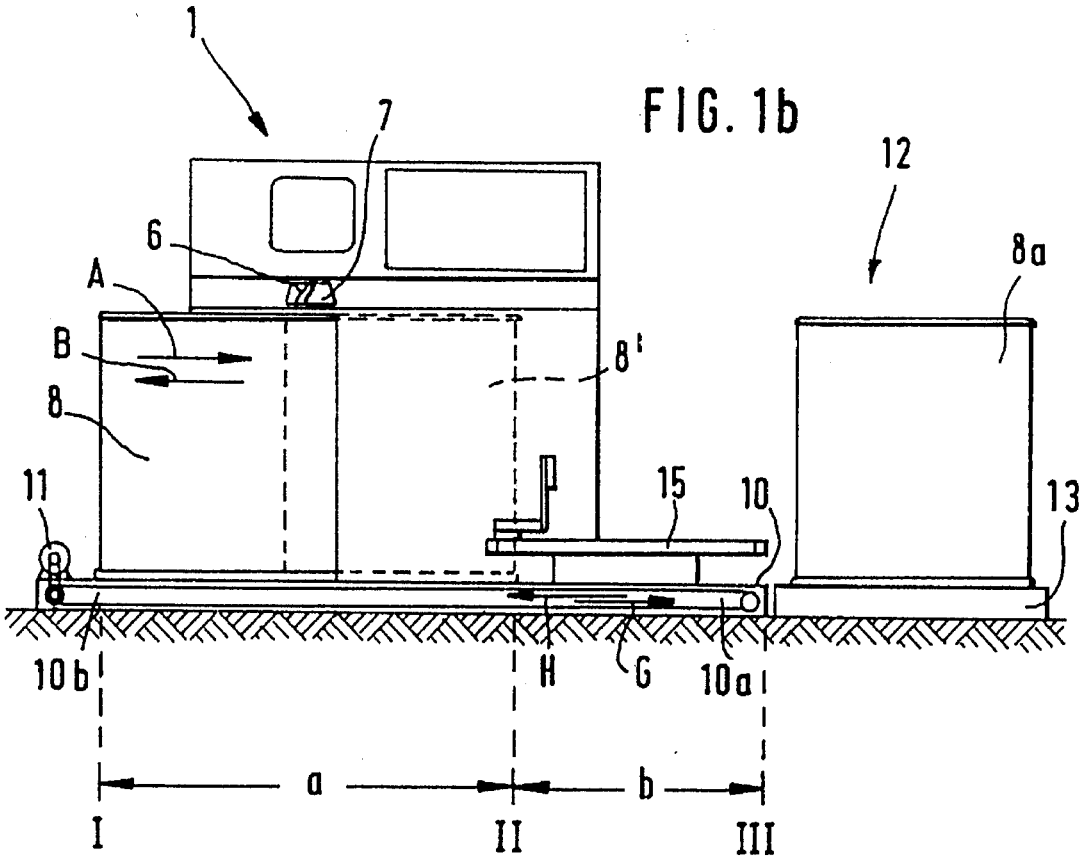
FIG. 1*b* is a schematic side elevational view of the construction illustrated in FIG. 1*a*.

FIG. 1*b* shows the filling station which is arranged under the coiler head 7 and which supports a coiler can 8. The coiler head 7, supported in a non-illustrated frame, deposits the sliver 6 in coils as it rotates about a stationary axis. The sliver 6 is advanced to the coiler head 7 in a conventional manner by two cooperating calender rolls after exiting from the drawing unit 4 of the drawing frame 1. The diameter of the coiler head 7 approximately corresponds to the horizontal width measured between two opposite large vertical sides of the coiler can 8. As seen in FIG. 1*a*, the coiler can 8 is supported on a sled, carriage or similar component of a can conveyor 10. During the filling process the conveyor sled 9 executes a back-and-forth travel effected by the drive of the conveyor 10 in the direction of arrows A and B. As a result, the can reciprocates underneath the coiler head 7 along a filling path a generally corresponding to the horizontal length of the coiler can and having reversal points (end points) I and II. The can replacement motion extends beyond the filling path a and defines a conveying path b having end points II and III. In FIG. 1*b* the coiler can 8 is shown in solid lines at the left end of the filling path and it is shown in phantom lines at 8' at the right end of the filling path a. The conveyor 10 is driven by an rpm-regulatable electric motor 11.

Parallel to the longitudinal side of the drawing frame 1 a can storing unit 12 is provided which is formed of an empty-can storing device 12*a* for the empty cans 8*a* and a full-can storing device 12*b* for the full cans 8*b*. As viewed in the direction of motion indicated by the arrows C and D, between the last empty can 8*a* and the first full can 8*b* an intermediate space 12*c* is provided. The empty cans and full cans 8*a* and 8*b*, respectively, are supported on a conveyor belt 13 which is an endless member supported by end rollers 13*a* and 13*b* and is circulated by an electric motor 14.

Prior to the filling step an empty coiler can 8*a* is moved from the empty-can storing device 12*a* into the intermediate space 12*c* between the empty-can storing device 12*a* and the full-can storing device 12*b* and therefrom the can is advanced to the filling station. After the filling process the full can 8 is moved by the sled 9 of the conveyor 10 from the filling station into the intermediate space 12*c* from which the can is moved to the full-can storing device 12*b*. The conveyor 10 is oriented perpendicularly to the can storing unit 12 and thus transports the cans individually to and from the filling station below the coiler head 7. Therefore, on the conveying path b either an empty can 8*a* is moved from the can storing unit 12 into the filling station or a full can 8*b* is moved from the filling station into the storing unit 12.

A transferring device 15 is provided to transfer an empty can 8*a* from the intermediate space 12*c* to the conveyor 10 and to transfer a full can 8*b* after the filling process from the conveyor 10 into the intermediate space 12*c*.

Figure 1C:
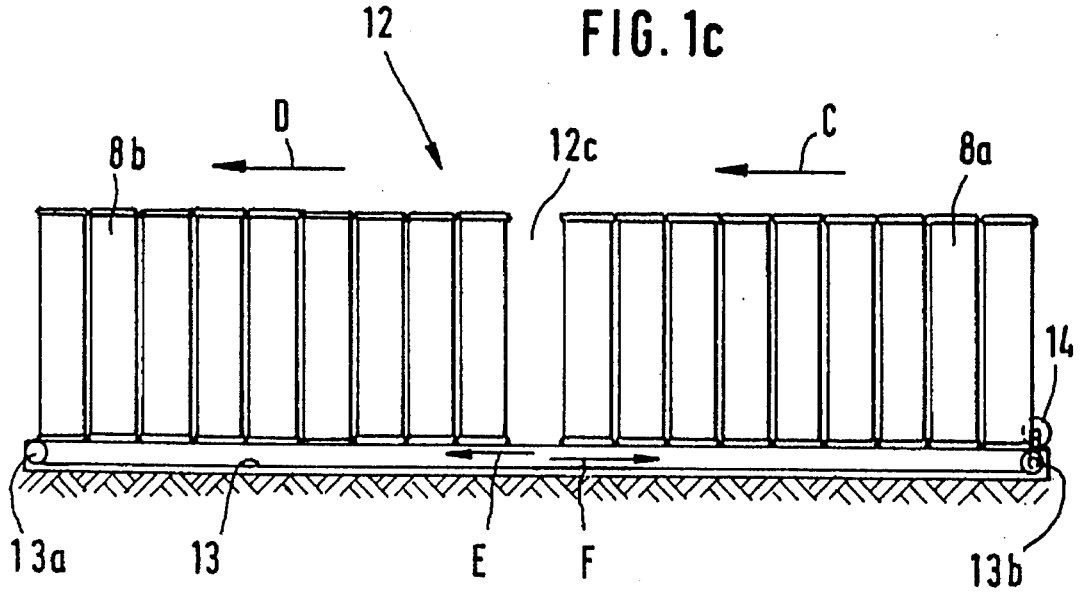
FIG. 1*c* is a schematic side elevational view of the can storing device shown in FIG. 1*a*.

Turning now to FIG. 1*c*, the empty-can storing device 12*a* and the full-can storing device 12*b* form a common can storing unit 12 constituted by a single structural unit. The can storing unit 12 has a common, throughgoing, endless conveyor belt 13 which is supported by end rollers 13*a* and 3*b* and which is circulated such that its working (upper) run moves in the direction of the arrow E, whereas its lower (idle or return) run moves in the direction of the arrow F. The conveyor belt 13 has carrier strips 17 which, as may be best observed in Figure la, extend perpendicularly to the conveying direction C, D of the conveyor belt 13 and define individual compartments for accommodating individual coiler cans.

Figure 1D:
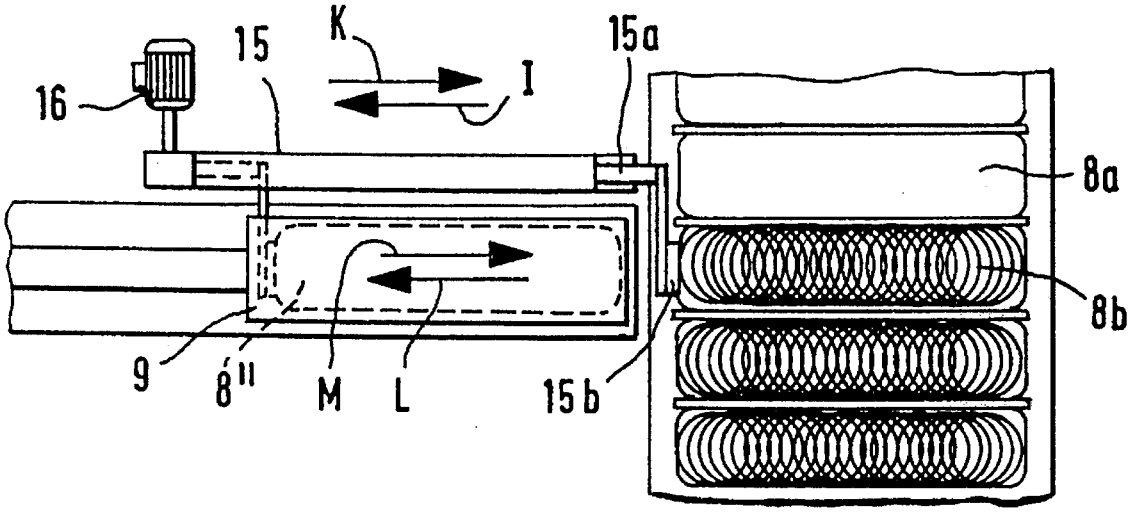
FIG. 1*d* is a schematic top plan view of a preferred embodiment of a can transferring device according to the invention.

Turning to FIG. 1*d*, there is illustrated therein the can transferring device 15 including a pushing and pulling arm 15*a* which is displaceable by a pushing and pulling element 15*b* in the direction of the arrows I and K. The pushing and pulling element 15*b* is driven by an electric motor 16. It is to be understood that instead of an electric motor a fluid displacement motor may be used as well.

Figure 2:
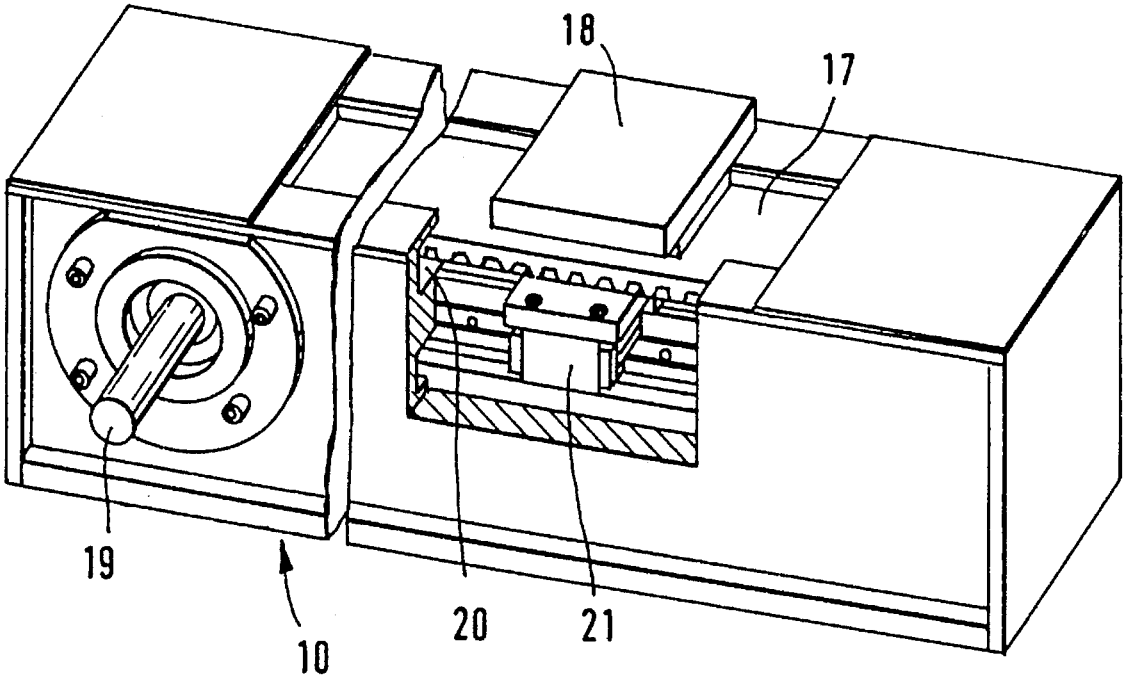
FIG. 2 is a perspective, partially broken-away view of a can conveyor according to the invention.

As shown in FIG. 2, the conveyor 10 which operatively couples the intermediate space 12*c* with the sliver filling station underneath the coiler head 7, has a toothed belt 17 on which a mounting plate 18 is secured for positioning the sled 9 thereon. The stub shaft 19 for driving the non-illustrated end roller for the belt 17 is coupled to the reversible drive motor 11. The belt 17 is guided in a slide strip 20 and a guide 21.

Figure 3:
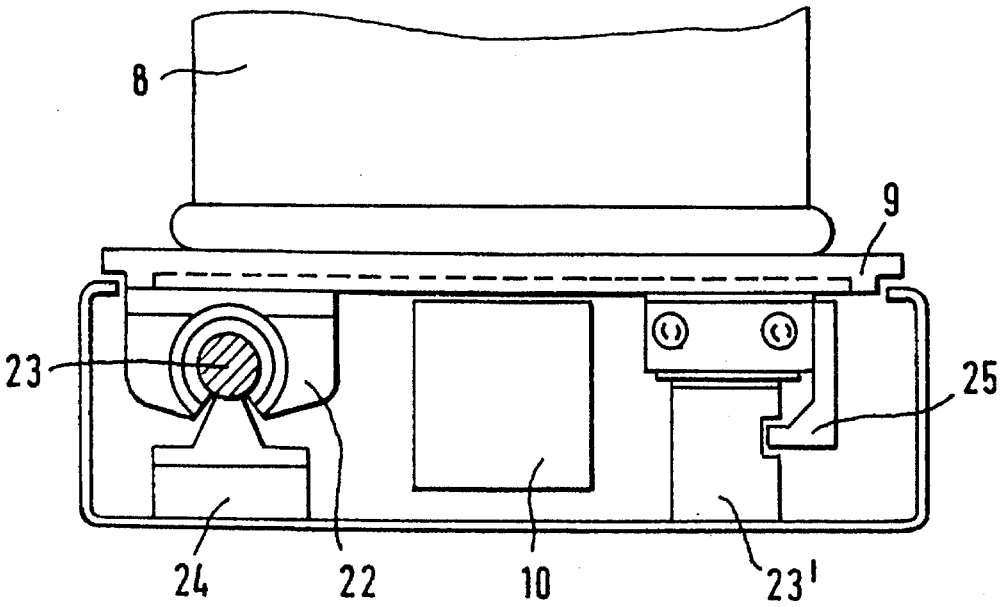
FIG. 3 is a sectional front elevational view of the can conveyor shown in FIG. 2.

As shown in FIG. 3, the flat can 8, whose horizontal width dimension faces the viewer, is positioned in a longitudinal orientation on the sled 9 which carries at its underside a sliding guide 22 partially circumferentially surrounding a stationary guide rod 23 supported on a carrier block 24. A further guide rod 23' is spaced parallel to the guide rod 23 and is formed as a sliding track for the other side of the sled 9 which is guided by the cooperation between a guide lug 25 travelling with the sled 9 and a guide track 23" provided laterally in the guide rod 23'.

Figure 4:
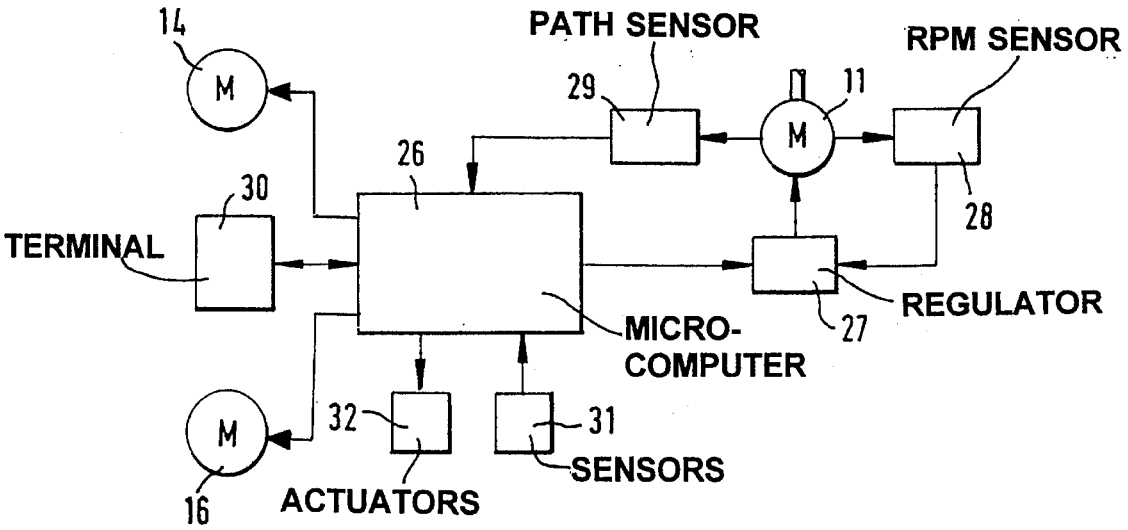
FIG. 4 is a block diagram of an electronic control and regulating device for operating the can handling apparatus according to the invention.

Turning to FIG. 4, there is provided an electronic control and regulating device, such as a microcomputer 26 to which an input of the electric motor 11 is connected with the interposition of a motor regulator 27. The drive motor 11 is connected with the microcomputer 26 with the interposition of a path sensor 29 which may be, for example, an incremental path sensor. The microcomputer 26 is further connected with a terminal 30, sensors 31 and actuators 32, the motor 16 for the can transferring device 15, the motor 14 for the can storing unit 12 as well as measuring and setting members for the control and regulation of the drawing frame 1.

The path sensor 29 applies signals to the microcomputer 26 representing the momentary position of the can 8 to be filled with sliver. The length of the filling path a on which the can is reciprocated during the filling step has structural characteristics (such as, for example, reversal point I=0 and reversal point II=100) which are stored in the microcomputer 26 according to a particular program. As long as the can is not full, it is reciprocated with a predetermined speed M along the filling path a between the two end points I and II. As soon as the maximum fill is reached which is determined by a fill level sensor 31, the can 8 is moved beyond the terminal point II towards the terminal point III along the conveying path b. Therefrom the can is laterally advanced and a new empty can 8*a* is brought to point III where the can is contacted and moved into the zone of the filling path a. Thereafter, a new filling process may start.

Figure 5A:
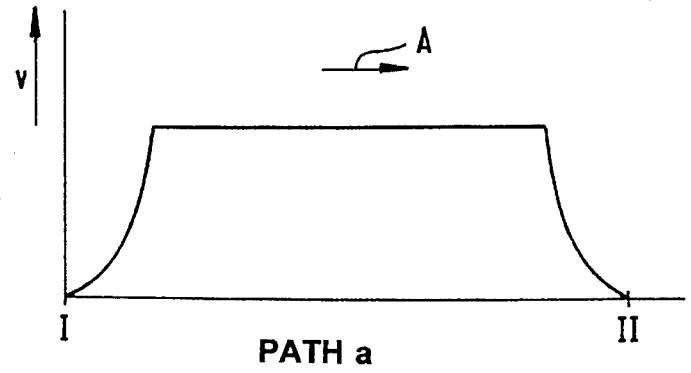
FIGS. 5*a* and 5*b* are diagrams illustrating the displacement speed of a can as a function of its position along the filling path.
Figure 5B:
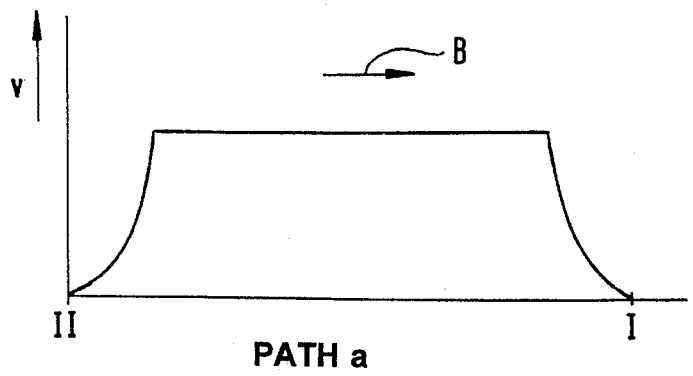

The speed v with which the can 8 is reciprocated between the end points I and II of the charging path a is variable and may be stored in the microcomputer 26 and may be applied thereby to the motor regulator 27 dependent on requirements. In particular, shortly before reaching the end points, the conveyor 10 may be braked according to a programmed course. Upon reaching a point of reversal, the direction of motion is reversed and the can is accelerated according to a programmable function as shown, for example, in FIGS. 5*a* and 5*b*. For example, the electric motor 11 may be constantly accelerated or decelerated. The speed M with which the can 8 is moved on the filling path a during the filling process is dependent from the output speed of the fiber processing machine (drawing frame) 1 and is electronically directly synchronized therewith.

The speed with which the can 8 is moved on the conveying path b may be adapted to the can filling process.

The invention also encompasses an embodiment where the device 10 directly displaces the can 8 which is moved on a conveyor apparatus, such as a roller track.

It will be understood that the above description of the present invention is susceptible to various modifications, changes and adaptations, and the same are intended to be comprehended within the meaning and range of equivalents of the appended claims.

What is claimed is:

1. A conveyor apparatus for moving flat coiler cans into and out of a sliver filling station and for reciprocating the cans in the sliver filling station while being filled with sliver by a sliver producing textile machine; the apparatus comprising (a) a conveyor element formed by a conveyor belt extending along a filling path within the sliver filling station and along a conveying path beyond the sliver filling station;

(b) means defining a surface on said conveyor belt for accommodating a coiler can in an upright position;

(c) support means for supporting said conveyor belt; and (d) drive means for unidirectionally moving the conveyor belt to introduce a can into and withdraw a can from the sliver filling station along the conveying path and for reciprocating the conveyor belt to displace a can back-and-forth along the filling path; said drive means comprising (1) an electric motor; and (2) an electronic control and regulating device; said electric motor being connected to said electronic control and regulating device.

2. The apparatus as defined in claim 1, wherein said means defining a surface comprises a platform secured to said conveyor belt.

3. The apparatus as defined in claim 1, wherein said conveyor belt is an endless belt and said support means comprises end rollers about which said endless belt is trained.

4. The apparatus as defined in claim 1, wherein said electric motor is reversible.

5. The apparatus as defined In claim 1, wherein said electric motor is rpm-regulatable.

6. The apparatus as defined in claim 1, wherein said electric motor is an a.c. servo-motor.

7. The apparatus as defined in claim 1, wherein said electric motor is a d.c. motor.

8. The apparatus as defined in claim 1, further comprising a fill level sensor for detecting a fill level in a can undergoing sliver filling said fill level sensor being connected to said electronic control and regulating device.

9. The apparatus as defined in claim 1, further comprising a path sensor for detecting a location of a can on the filling path and on the conveying path said path sensor being connected to said electronic control and regulating device.

* * * * *

UNITED STATES PATENT AND TRADEMARK OFFICE

CERTIFICATE OF CORRECTION

PATENT NO. : 5,560,179
DATED : October 1, 1996
INVENTOR(S) : Ferdinand Leifeld

It is certified that error appears in the above-indentified patent and that said Letters Patent is hereby corrected as shown below:

On the title page, item [30], after "Foreign Application Priority Data", the following should be inserted:

--May 14, 1993 [DE] Germany ..... 43 16 159.6
April 2, 1994 [DE] Germany ..... 44 11 549.0--.

Signed and Sealed this
Twenty-sixth Day of November 1996

*Attest:*

*Attesting Officer*

Bruce Lehman

BRUCE LEHMAN

*Commissioner of Patents and Trademarks*